US007653969B2

(12) United States Patent
Erskine et al.

(10) Patent No.: US 7,653,969 B2
(45) Date of Patent: Feb. 2, 2010

(54) THREE-PIECE HINGE

(75) Inventors: Edward J. Erskine, Benson, NY (US); Robert R. Shearer, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 543 days.

(21) Appl. No.: 11/189,740

(22) Filed: Jul. 27, 2005

(65) Prior Publication Data

US 2007/0022571 A1 Feb. 1, 2007

(51) Int. Cl.
*E05D 7/00* (2006.01)

(52) U.S. Cl. ..... 16/365; 16/366; 16/269; 16/389

(58) Field of Classification Search ..... 16/366, 16/355, 356, 390, 267, 268, 269, DIG. 29, 16/365; 160/206; 4/556, 557, 236; 49/397, 49/381

See application file for complete search history.

(56) References Cited

U.S. PATENT DOCUMENTS 731,138 A * 6/1903 Stearns ..... 52/72
1,939,728 A 12/1933 Spaunburg
2,177,617 A * 10/1939 Hinton ..... 49/56
2,642,018 A * 6/1953 Weeber ..... 52/277
3,718,943 A * 3/1973 Bustin ..... 16/355
3,806,188 A 4/1974 Tantlinger
3,962,827 A * 6/1976 Chaffee ..... 49/384
4,694,533 A * 9/1987 Doyen ..... 16/257
4,777,777 A 10/1988 Massimo
4,953,261 A 9/1990 Lyons
4,968,171 A * 11/1990 Shell ..... 403/4
5,133,108 A 7/1992 Esnault
5,203,277 A * 4/1993 Norman ..... 114/361
5,309,860 A 5/1994 Shearer
5,329,667 A 7/1994 Erskine
5,356,095 A * 10/1994 Aker ..... 244/172.6
5,363,616 A 11/1994 Hernandez
5,448,799 A 9/1995 Stein, Jr.
5,502,930 A * 4/1996 Burkette et al. ..... 52/71
5,682,643 A * 11/1997 Duffy ..... 16/265
5,742,980 A * 4/1998 Nitta ..... 16/355
5,782,282 A * 7/1998 Chen ..... 160/206
5,809,617 A * 9/1998 Harris et al. ..... 16/273

(Continued)

FOREIGN PATENT DOCUMENTS

EP 163455 A2 * 12/1985

(Continued)

*Primary Examiner*—Victor Batson
*Assistant Examiner*—Jeffrey O'Brien
(74) *Attorney, Agent, or Firm*—Nixon & Vanderhye P.C.

(57) ABSTRACT

A three-piece hinge supports a two-panel window assembly in a frame. The hinge includes a base member securable to the frame, a first pivot member pivotably coupled with the base member at a first pivot joint, and a second pivot member pivotably coupled with the base member at a second pivot joint spaced from the first pivot joint. The first and second pivot members each have a glass channel for supporting a panel of the two-panel window assembly. In one arrangement, an insert is secured in a pivoting path of the second pivot member to thereby limit a pivot range of the second pivot member. The hinge eliminates the significant machining time required for prior hinge designs, thereby resulting in a simpler less expensive hinge.

17 Claims, 2 Drawing Sheets

U.S. PATENT DOCUMENTS

| | | | | |
|---|---|---|---|---|
| 5,842,508 | A | 12/1998 | Krupke et al. | |
| 5,915,446 | A | 6/1999 | De Zen | |
| 6,145,165 | A * | 11/2000 | Torcato | 16/355 |
| 6,499,188 | B1 | 12/2002 | Cheng | |
| 6,647,914 | B1 | 11/2003 | Gerhardinger et al. | |
| 6,687,956 | B1 | 2/2004 | Foo | |
| 6,691,370 | B2 * | 2/2004 | Tatara | 16/355 |
| 2003/0200628 | A1 * | 10/2003 | Tatara | 16/355 |

FOREIGN PATENT DOCUMENTS

| | | | |
|---|---|---|---|
| GB | 2241020 | A * | 8/1991 |
| JP | 54100129 | A * | 8/1979 |
| JP | 62-2018 | | 1/1987 |
| WO | WO 9401033 | A1 * | 1/1994 |

* cited by examiner

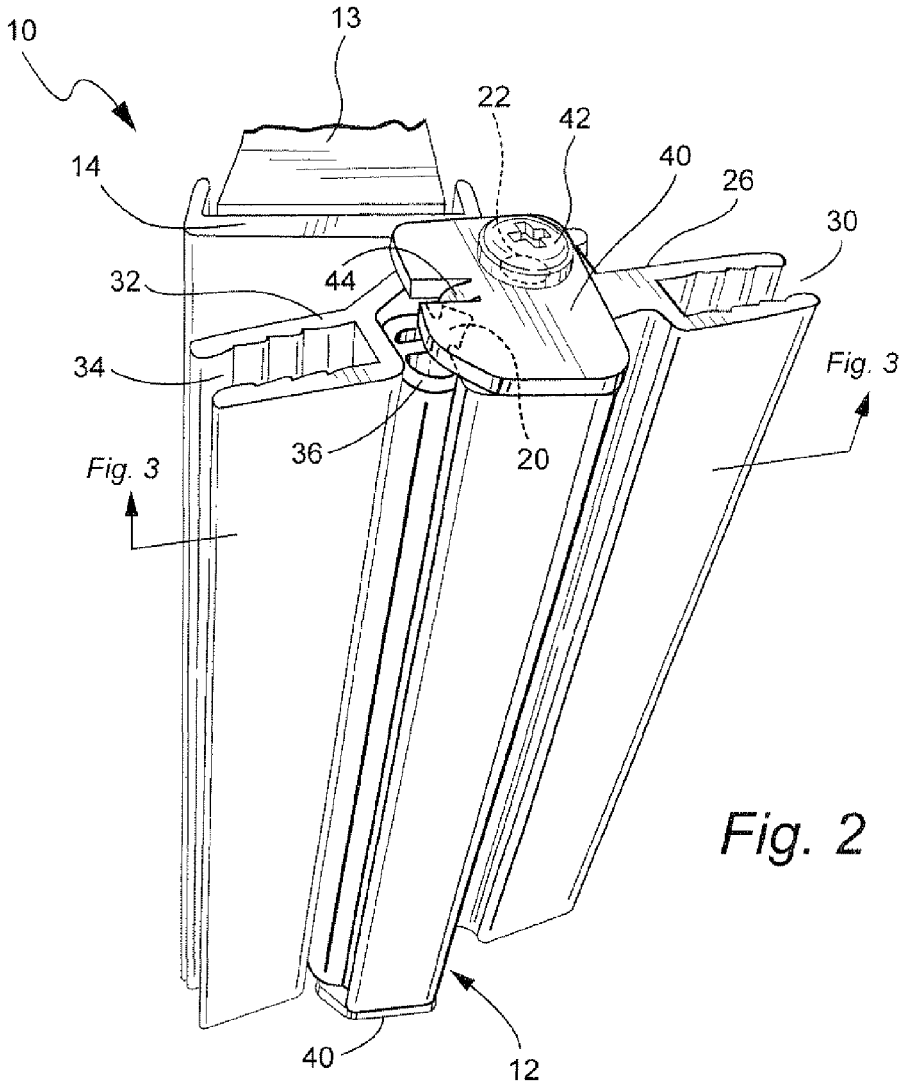
Fig. 2
Fig. 3
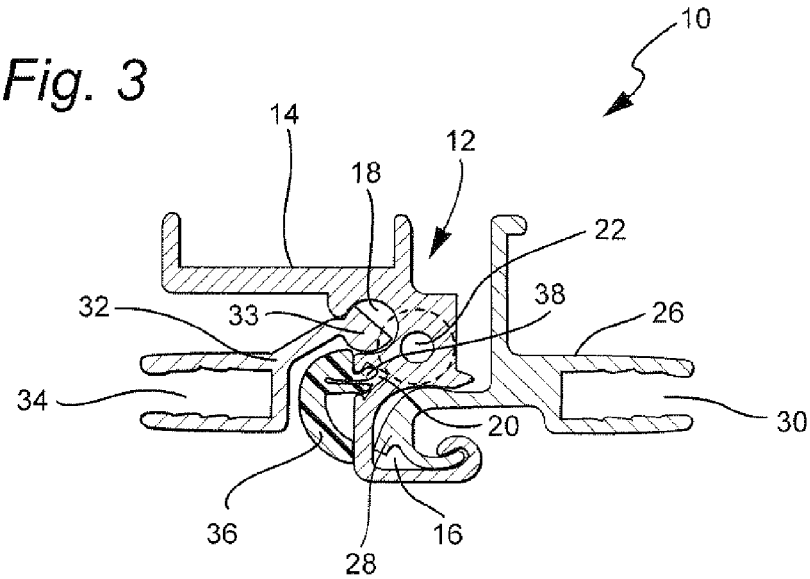

THREE-PIECE HINGE

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to a hinge assembly and, more particularly, to a three-piece hinge assembly for supporting a two-panel window in a frame.

Window units in construction vehicles and the like have been configured with two panels supported in a door frame with a hinge between them. In a typical arrangement, one of the window panels can be opened completely by pivoting through about 180° and being held in the open position by a suitable latching mechanism, which is often connected through the other window panel. The second window panel may also be capable of opening but typically only pivoting through 10-30° to avoid interfering with the other window panel.

In order to form such a hinge, the hinge may include structure for attaching the hinge to the door frame as well as two pivoting components including glass channels to support the glass panels. An exemplary prior art hinge is shown in cross section in FIG. 1. The multiple components of the hinge are connected together by aligning generally circular staggered elements affixed at ends of the hinge components to receive a pin, about which the components are pivotable. While such hinges effectively perform their intended function, there are significant difficulties in assembling the components and long machining times associated therewith. As such, manufacturing costs are increased. In order to eliminate such problems, there have been commercial prior art systems developed, such as the "Roton" system that utilizes pinless hinges by providing cooperating gear elements attached to the panels. Such prior art pinless systems, however, are typically complicated, and prior art two-component hinges are not capable of more than 140° relative movement with respect to each other.

BRIEF SUMMARY OF THE INVENTION

The three-piece hinge assembly of the invention includes cooperable components that are easy and inexpensive to manufacture. The components do not require the considerable machining time required of the existing designs. One of the hinge members is pivotable through at least 180°, while a second hinge member may be limited according to desired functionality.

In an exemplary embodiment of the invention, a three-piece hinge supports a two-panel window assembly in a frame. The hinge includes a base member securable to the frame and a first pivot member pivotably coupled with the base member at a first pivot joint. The first pivot member has a first glass channel. A second pivot member is pivotably coupled with the base member at a second pivot joint spaced from the first pivot joint. The second pivot member has a second glass channel. The base member, the first pivot member and the second pivot member may be formed of an extruded material. An insert, which may be formed of a vinyl extrusion, is preferably secured in a pivoting path of the second pivot member to limit a pivot range of the second pivot member. In one embodiment, the pivot range of the second pivot member is limited to about 15°. A pivot range of the first pivot member is preferably about 180°.

The hinge may additionally include two end plates each affixed to an end of the base member to prevent the base member, the first pivot member and the second pivot member from sliding longitudinally relative to one another. In this context, each end plate may include a tab that engages the base member when the end plates are affixed to the base member to prevent the end plates from rotating relative to the hinge. Preferably, each of the end plates is affixed to the base member via single screw.

In another exemplary embodiment of the invention, a door includes a two-panel window assembly supported by the three-piece hinge of the invention.

In yet another exemplary embodiment of the invention, a three-piece hinge includes a base member securable to the frame, where the base member has a first pivot joint and a second pivot joint. A first pivot member includes a connecting end engaging the first pivot joint and includes a first glass channel. The connecting end and the first pivot joint are configured such that the first pivot member is pivotable through at least 140°. A second pivot member is pivotably coupled with the base member at the second pivot joint spaced from the first pivot joint. The second pivot member includes a second glass channel. An insert is affixed to the base member in a pivoting path of the second pivot member to limit a pivot range of the second pivot member.

The base member preferably further includes an insert groove in which the insert is secured. An end plate may be affixed to each end of the base member, where each end plate has a tab that engages the insert groove of the base member when the end plates are affixed to the base member to prevent the end plates from rotating relative to the hinge.

In still another exemplary embodiment of the invention, a method of installing a two-panel window assembly in a frame using the three-piece hinge of the invention includes the steps of installing glass panels in the glass channels of the first and second pivot members, respectively; inserting the first member into the first pivot joint; securing the base member to the frame; inserting the second pivot member into the second pivot joint; and affixing the insert to the base member after inserting the second pivot member.

BRIEF DESCRIPTION OF THE DRAWINGS

These and other aspects and advantages of the present invention will be described in detail with reference to the accompanying drawings, in which:

FIG. 2 is a perspective view of the three-piece hinge according to the present invention; and FIG. 3 is a cross sectional view of the three-piece hinge.

DETAILED DESCRIPTION OF THE INVENTION

Figure 1:
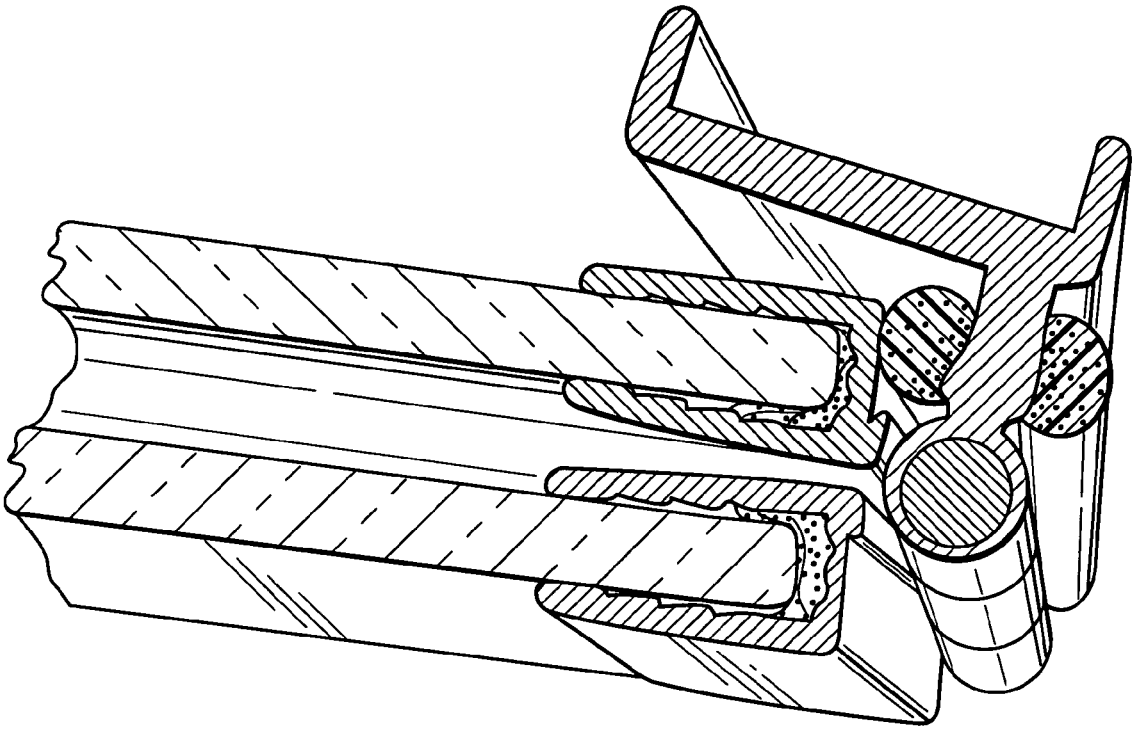
Fig. 1 (Prior Art)
FIG. 1 is a cross sectional view of a prior art hinge design.

With reference to FIGS. 2 and 3, the three-piece hinge assembly 10 of the present invention includes a base member 12 that is securable to the window or door frame 13 via a securing channel 14. The base member 12 is formed with a first pivot joint 16, a second pivot joint 18 spaced from the first pivot joint 16 as shown, and an insert groove 20. A hole or aperture 22 is formed in a central portion of the base member 12.

A first pivot member 26 is pivotably coupled with the base member 12 at the first pivot joint 16. The first pivot member 26 also includes a glass channel 30 for receiving one of the window panels. The first pivot member 26 has a connecting end 28 that is shaped cooperatively with a first pivot joint 16 such that the first pivot member 26 is pivotable through at least 140° and preferably at least 180°. The size and shape of the connecting end 28 and the first pivot joint 16 may be defined in any suitable manner to effect the desired functionality. Similarly cooperative elements are described in U.S. Pat. No. 5,329,667, the contents of which are hereby incorporated by reference.

A second pivot member 32 is pivotably coupled with the base member 12 at the second pivot joint 18. The second pivot member 32 also includes a glass channel 34 for receiving a second window panel. The second pivot member 32 has a connecting end 33 engaging the second pivot joint 18 for rotation therein. The connecting end 33 is shaped such that if the second pivot member 32 and corresponding glass panel can be installed with the base member 12 and first pivot member 26 in place.

In order to prevent the second pivot member 32 from rotating beyond a point at which the second pivot member 32 would release from the second pivot joint 18, an insert 36, preferably formed of extruded vinyl, may be snapped into or engaged with the insert groove 20 in the base member 12 via an engaging ridge 38. As shown in FIG. 3, the insert 36 is thus affixed to the base member 12 in a pivoting path of the second pivot member 32, thereby limiting a pivot range of the second pivot member 32. Preferably, the insert 36 is sized to limit the pivot range of the second pivot member 32 to less than 30° and preferably to about 15°.

As shown in FIG. 2, end plates 40 are fixed to each end of the base member 12 to prevent the base member 12, the first pivot member 26, the second pivot member 32 and the insert 36 from sliding longitudinally relative to one another. The end plates 40 are preferably secured to the base member 12 via a single screw 42 in the aperture 22. In order to prevent the end plates 40 from rotating about the single screw, each end plate 40 includes a tab 44 that engages the insert groove 20 of the base member 12 when the end plates 40 are affixed to the base member 12. The insert 36 is appropriately sized to leave space for the tab 44 of each end plate 40.

The base member, first pivot member and second pivot member are preferably formed of an extruded material such as aluminum. Extruded components are more economical to manufacture. Additionally, the components can be more easily manufactured within tolerances, and the assembled product contains fewer parts.

In manufacturing a two-panel window assembly using the three-piece hinge of the invention, the glass panels of the window assembly are first installed preferably with an adhesive in the glass channels 30, 34 of the first and second pivot members, respectively. The first pivot member 26 is then inserted into the first pivot joint 16, and the end plates 40 are affixed to the base member 12 via the single screw 42. The base member 12 is next secured to the frame via rivets or the like through the securing channel 14. The second pivot member 32 is inserted (rotated) into the second pivot joint 18, and the insert 36 is affixed to the base member 12. The second pivot member 32 covers the installation fasteners in the securing channel. Finally, the window opening hardware is installed.

The structure of the hinge assembly according to the invention eliminates most of the machining time required with the current hinge design. As a consequence, the hinge assembly can be manufactured faster and at a lower cost. The hinge is also easy to assemble and maintain.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A three-piece hinge for supporting a two-panel window assembly in a frame, the three-piece hinge comprising:

a base member securable to the frame;

a first pivot member pivotably coupled with the base member at a first pivot joint, the first pivot member having a first glass channel; and a second pivot member pivotably coupled with the base member at a second pivot joint spaced from the first pivot joint, the second pivot member having a second glass channel, the base member, the first pivot member and the second pivot member defining the three-piece hinge without a hinge pin, wherein the first pivot member comprises a connecting end that is shaped cooperatively with the first pivot joint such that a pivot range of the first pivot member is at least 180° relative to the base member.

2. A hinge according to claim 1, further comprising an insert secured in a pivoting path of the second pivot member, the insert limiting a pivot range of the second pivot member.

3. A hinge according to claim 2, wherein the pivot range of the second pivot member is limited to about 15°.

4. A hinge according to claim 2, wherein the insert comprises a vinyl extrusion.

5. A hinge according to claim 1, wherein the base member, the first pivot member and the second pivot member are formed of an extruded material.

6. A hinge according to claim 1, further comprising two end plates each affixed to an end of the base member, the end plates preventing the base member, the first pivot member and the second pivot member from sliding longitudinally relative to one another.

7. A hinge according to claim 6, wherein each end plate comprises a tab that engages the base member when the end plates are affixed to the base member, the tab preventing the end plates from rotating relative to the hinge.

8. A hinge according to claim 6, wherein each of the end plates is affixed to the base member via single screw.

9. A door including a two-panel window assembly, the door comprising:

a door frame; and a three-piece hinge affixed to the door frame and supporting the two-panel window assembly, the three-piece hinge including:

a base member secured to the door frame, a first pivot member pivotably coupled with the base member at a first pivot joint, the first pivot member having a first glass channel, and a second pivot member pivotably coupled with the base member at a second pivot joint spaced from the first pivot joint, the second pivot member having a second glass channel, the base member, the first pivot member and the second pivot member defining the three-piece hinge without a hinge pin, wherein the first pivot member comprises a connecting end that is shaped cooperatively with the first pivot joint such that a pivot range of the first pivot member is at least 180° relative to the base member.

10. A three-piece hinge for supporting a two-panel window assembly in a frame, the three-piece hinge comprising:

a base member securable to the frame, the base member including a first pivot joint and a second pivot joint;

a first pivot member having a connecting end engaging the first pivot joint, the first pivot member having a first glass channel, wherein the connecting end is shaped cooperatively with the first pivot joint such that the first pivot member is pivotable through at least 180° relative to the base member;

a second pivot member pivotably coupled with the base member at the second pivot joint spaced from the first pivot joint, the second pivot member having a second glass channel; and an insert affixed to the base member in a pivoting path of the second pivot member and separate from the second pivot member, the insert limiting a pivot range of the second pivot member, the base member, the first pivot member and the second pivot member defining the three-piece hinge without a hinge pin.

11. A hinge according to claim 10, wherein the pivot range of the second pivot member is limited to about 15°.

12. A hinge according to claim 10, wherein the base member further comprises an insert groove, and wherein the insert is secured to the base member in the insert groove.

13. A hinge according to claim 12, further comprising two end plates each affixed to an end of the base member, the end plates preventing the base member, the first pivot member, the second pivot member, and the insert from sliding longitudinally relative to one another.

14. A hinge according to claim 13, wherein each end plate comprises a tab that engages the insert groove of the base member when the end plates are affixed to the base member, the tab preventing the end plates from rotating relative to the hinge.

15. A hinge according to claim 13, wherein each of the end plates is affixed to the base member via single screw.

16. A method of installing a two-panel window assembly in a frame using the three-piece hinge of claim 10, the method comprising:

installing glass panels in the glass channels of the first and second pivot members, respectively;

inserting the first member into the first pivot joint;

securing the base member to the frame;

inserting the second pivot member into the second pivot joint; and affixing the insert to the base member after inserting the second pivot member.

17. A method according to claim 16, further comprising securing an end plate to opposite ends of the base member to prevent the base member, the first pivot member, the second pivot member, and the insert from sliding longitudinally relative to one another.

* * * * *